US007798434B2

(12) United States Patent
Bondeson et al.

(10) Patent No.: US 7,798,434 B2
(45) Date of Patent: Sep. 21, 2010

(54) MULTI-PLATE NOZZLE AND METHOD FOR DISPENSING RANDOM PATTERN OF ADHESIVE FILAMENTS

(75) Inventors: Benjamin J. Bondeson, Suwanee, GA (US); Thomas Burmester, Bleckede (DE); Hubert Kufner, Luneburg (DE); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 951 days.

(21) Appl. No.: 11/610,148

(22) Filed: Dec. 13, 2006

(65) Prior Publication Data

US 2008/0145530 A1 Jun. 19, 2008

(51) Int. Cl.

| | |
|---|---|
| ***B05B 1/28*** | (2006.01) |
| ***B05B 7/10*** | (2006.01) |
| ***B05B 1/14*** | (2006.01) |
| ***B05B 1/26*** | (2006.01) |
| ***F23D 14/68*** | (2006.01) |
| ***A62C 31/02*** | (2006.01) |

(52) U.S. Cl. ..... 239/601; 239/296; 239/299; 239/406; 239/553; 239/553.3; 239/553.5; 239/590.3

(58) Field of Classification Search ..... 239/290, 239/294, 295, 296, 298, 299, 406, 548, 549, 239/552, 553, 553.3, 553.5, 555, 556, 557, 239/561, 568, 590.3, 601; 427/207.1, 208.6, 427/286; 118/313, 315

See application file for complete search history.

(56) References Cited

U.S. PATENT DOCUMENTS 2,031,387 A 2/1936 Schwarz (Continued)

FOREIGN PATENT DOCUMENTS

DE 3543469 A1 12/1985

(Continued)

OTHER PUBLICATIONS

Rajiv S. Rao et al., Vibration and Stability in the Melt Blowing Process, Ind. Eng. Chem. Res., 1993, 32, 3100-3111.

(Continued)

*Primary Examiner*—Dinh Q Nguyen
*Assistant Examiner*—Ryan Reis
(74) *Attorney, Agent, or Firm*—Wood, Herron & Evans, L.L.P.

(57) ABSTRACT

A nozzle for dispensing a random pattern of liquid adhesive filaments. The nozzle may include first and second air shim plates, an adhesive shim plate and first and second separating shim plates. The first and second air shim plates each have respective pairs of air slots. Each air slot has a process air inlet and a process air outlet and the air slots of each pair converge toward one another such that the process air inlets are farther apart than the process air outlets in each pair. The adhesive shim plate includes a plurality of liquid slots each with a liquid outlet. Four process air outlets are associated with each of the liquid outlets. The process air slots are adapted to receive pressurized process air and the liquid slots are adapted to receive pressurized liquid adhesive. The pressurized process air discharges from each group of the four process air outlets and forms a zone of turbulence for moving the filament of liquid adhesive discharging from the associated liquid outlet in a random pattern.

6 Claims, 7 Drawing Sheets

U.S. PATENT DOCUMENTS

| | | | | |
|---|---|---|---|---|
| 2,212,448 | A | | 8/1940 | Modigliani |
| 2,297,726 | A | | 10/1942 | Stephanoff |
| 2,628,386 | A | | 2/1953 | Tornberg |
| 3,032,008 | A | | 5/1962 | Land et al. |
| 3,038,202 | A | | 6/1962 | Harkenrider |
| 3,176,345 | A | | 4/1965 | Powell |
| 3,178,770 | A | | 4/1965 | Willis |
| 3,181,738 | A | | 5/1965 | Hartvig-Johansen |
| 3,192,562 | A | | 7/1965 | Powell |
| 3,192,563 | A | | 7/1965 | Crompton |
| 3,204,290 | A | * | 9/1965 | Crompton ..... 425/190 |
| 3,213,170 | A | | 10/1965 | Erdmenger et al. |
| 3,253,301 | A | | 5/1966 | McGlaughlin |
| 3,334,792 | A | | 8/1967 | Vries et al. |
| 3,379,811 | A | | 4/1968 | Hartmann et al. |
| 3,380,128 | A | | 4/1968 | Cremer et al. |
| 3,488,806 | A | | 1/1970 | De Cecco et al. |
| 3,492,692 | A | | 2/1970 | Soda et al. |
| 3,501,805 | A | | 3/1970 | Douglas, Jr. et al. |
| 3,613,170 | A | | 10/1971 | Soda et al. |
| 3,650,866 | A | | 3/1972 | Prentice |
| 3,704,198 | A | | 11/1972 | Prentice |
| 3,730,662 | A | | 5/1973 | Nunning |
| 3,755,527 | A | | 8/1973 | Keller et al. |
| 3,801,400 | A | | 4/1974 | Vogt et al. |
| 3,803,951 | A | | 4/1974 | Bagley |
| 3,806,289 | A | | 4/1974 | Schwarz |
| 3,807,917 | A | | 4/1974 | Shimoda et al. |
| 3,825,379 | A | | 7/1974 | Lohkamp et al. |
| 3,847,537 | A | | 11/1974 | Velie |
| 3,849,241 | A | | 11/1974 | Butin et al. |
| 3,852,013 | A | | 12/1974 | Upmeier |
| 3,861,850 | A | | 1/1975 | Wallis |
| 3,874,886 | A | | 4/1975 | Levecque et al. |
| 3,888,610 | A | | 6/1975 | Brackmann et al. |
| 3,920,362 | A | | 11/1975 | Bradt |
| 3,923,444 | A | | 12/1975 | Esper et al. |
| 3,942,723 | A | | 3/1976 | Langdon |
| 3,954,361 | A | | 5/1976 | Page |
| 3,970,417 | A | | 7/1976 | Page |
| 3,978,185 | A | | 8/1976 | Buntin et al. |
| 3,981,650 | A | | 9/1976 | Page |
| 4,007,625 | A | | 2/1977 | Houben et al. |
| 4,015,963 | A | | 4/1977 | Levecque et al. |
| 4,015,964 | A | | 4/1977 | Levecque et al. |
| 4,050,866 | A | | 9/1977 | Kilsdonk |
| 4,052,002 | A | | 10/1977 | Stouffer et al. |
| 4,052,183 | A | | 10/1977 | Levecque et al. |
| 4,100,324 | A | | 7/1978 | Anderson et al. |
| 4,145,173 | A | | 3/1979 | Pelzer et al. |
| 4,151,955 | A | | 5/1979 | Stouffer |
| 4,185,981 | A | | 1/1980 | Ohsato et al. |
| 4,189,455 | A | | 2/1980 | Raganato et al. |
| 4,277,436 | A | | 7/1981 | Shah et al. |
| 4,300,876 | A | | 11/1981 | Kane et al. |
| 4,340,563 | A | | 7/1982 | Appel et al. |
| 4,359,445 | A | | 11/1982 | Kane et al. |
| 4,380,570 | A | | 4/1983 | Schwarz |
| 4,414,276 | A | | 11/1983 | Kiriyama et al. |
| 4,457,685 | A | | 7/1984 | Huang et al. |
| 4,468,366 | A | | 8/1984 | Socha, Jr. |
| 4,526,733 | A | | 7/1985 | Lau |
| 4,548,632 | A | | 10/1985 | Tanaka et al. |
| 4,568,506 | A | | 2/1986 | Kiriyama et al. |
| 4,596,364 | A | | 6/1986 | Bauer |
| 4,645,444 | A | | 2/1987 | Lenk et al. |
| 4,652,225 | A | | 3/1987 | Dehennau et al. |
| 4,694,992 | A | | 9/1987 | Stouffer |
| 4,708,619 | A | | 11/1987 | Balk |
| 4,709,836 | A | | 12/1987 | Andersen |
| 4,711,683 | A | | 12/1987 | Merkatoris |
| 4,730,197 | A | | 3/1988 | Raman et al. |
| 4,746,283 | A | | 5/1988 | Hobson |
| 4,747,986 | A | | 5/1988 | Chao |
| 4,774,109 | A | | 9/1988 | Hadzimihalis et al. |
| 4,785,996 | A | | 11/1988 | Ziecker et al. |
| 4,812,276 | A | | 3/1989 | Chao |
| 4,818,463 | A | | 4/1989 | Buehning |
| 4,818,464 | A | | 4/1989 | Lau |
| 4,826,415 | A | | 5/1989 | Mende |
| 4,842,666 | A | | 6/1989 | Werenicz |
| 4,844,003 | A | | 7/1989 | Slautterback et al. |
| 4,874,451 | A | | 10/1989 | Boger et al. |
| 4,875,844 | A | | 10/1989 | Nakajima et al. |
| 4,889,476 | A | | 12/1989 | Buehning |
| RE33,158 | E | | 2/1990 | Stouffer et al. |
| RE33,159 | E | | 2/1990 | Bauer |
| 4,905,909 | A | | 3/1990 | Woods |
| 4,918,017 | A | | 4/1990 | Greenstreet et al. |
| 4,923,706 | A | | 5/1990 | Binley et al. |
| 4,949,668 | A | | 8/1990 | Heindel et al. |
| 4,955,547 | A | | 9/1990 | Woods |
| 4,960,619 | A | | 10/1990 | Slautterback et al. |
| RE33,448 | E | | 11/1990 | Bauer |
| RE33,481 | E | | 12/1990 | Ziecker et al. |
| 4,983,109 | A | | 1/1991 | Miller et al. |
| 5,013,232 | A | | 5/1991 | Way |
| 5,017,116 | A | | 5/1991 | Carter et al. |
| 5,035,361 | A | | 7/1991 | Stouffer |
| 5,066,435 | A | | 11/1991 | Lorenz et al. |
| 5,067,885 | A | | 11/1991 | Stevenson et al. |
| 5,069,853 | A | | 12/1991 | Miller |
| 5,094,792 | A | | 3/1992 | Baran |
| 5,098,636 | A | | 3/1992 | Balk |
| 5,114,752 | A | | 5/1992 | Hall |
| 5,124,111 | A | | 6/1992 | Keller et al. |
| 5,129,585 | A | | 7/1992 | Bauer |
| 5,145,689 | A | | 9/1992 | Allen et al. |
| 5,147,197 | A | | 9/1992 | Hodan et al. |
| 5,160,746 | A | | 11/1992 | Dodge, II et al. |
| 5,165,940 | A | | 11/1992 | Windley |
| 5,169,071 | A | | 12/1992 | Boger et al. |
| 5,209,410 | A | | 5/1993 | Wichmann et al. |
| 5,234,650 | A | | 8/1993 | Hagen et al. |
| 5,242,644 | A | | 9/1993 | Thompson et al. |
| 5,260,003 | A | | 11/1993 | Nyssen et al. |
| 5,269,670 | A | | 12/1993 | Allen et al. |
| 5,275,676 | A | | 1/1994 | Rooyakkers et al. |
| 5,312,500 | A | | 5/1994 | Kurihara et al. |
| 5,342,647 | A | | 8/1994 | Heindel et al. |
| 5,354,378 | A | | 10/1994 | Hauser et al. |
| 5,393,219 | A | | 2/1995 | Hagen et al. |
| 5,397,227 | A | | 3/1995 | Hodan et al. |
| 5,407,619 | A | | 4/1995 | Maeda et al. |
| 5,409,733 | A | | 4/1995 | Boger et al. |
| 5,418,009 | A | | 5/1995 | Raterman et al. |
| 5,421,921 | A | | 6/1995 | Gill et al. |
| 5,421,941 | A | | 6/1995 | Allen et al. |
| 5,423,935 | A | | 6/1995 | Benecke et al. |
| 5,429,840 | A | | 7/1995 | Raterman et al. |
| 5,445,509 | A | | 8/1995 | Allen et al. |
| 5,458,291 | A | | 10/1995 | Brusko et al. |
| 5,458,721 | A | | 10/1995 | Raterman |
| 5,476,616 | A | | 12/1995 | Schwarz |
| 5,478,224 | A | | 12/1995 | McGuffey |
| D367,865 | S | | 3/1996 | Bajadali |
| 5,503,784 | A | | 4/1996 | Balk |
| 5,512,793 | A | | 4/1996 | Takeuchi et al. |
| 5,524,828 | A | | 6/1996 | Raterman et al. |
| 5,533,675 | A | | 7/1996 | Benecke et al. |
| 5,540,804 | A | | 7/1996 | Raterman |
| 5,551,588 | A | | 9/1996 | Hills |
| 5,605,706 | A | | 2/1997 | Allen et al. |
| 5,618,347 | A | | 4/1997 | Clare et al. |

| | | | | |
|---|---|---|---|---|
| 5,618,566 | A | 4/1997 | Allen et al. | |
| 5,620,139 | A | 4/1997 | Ziecker | |
| 5,620,664 | A | 4/1997 | Palmer | |
| 5,645,790 | A | 7/1997 | Schwarz et al. | |
| 5,667,750 | A | 9/1997 | Nohr et al. | |
| 5,679,379 | A | 10/1997 | Fabbricante et al. | |
| 5,902,540 | A | 5/1999 | Kwok | |
| 5,904,298 | A * | 5/1999 | Kwok et al. | 239/135 |
| 5,927,560 | A | 7/1999 | Lewis et al. | |
| 5,964,973 | A | 10/1999 | Heath et al. | |
| 5,992,688 | A | 11/1999 | Lewis et al. | |
| D420,099 | S | 2/2000 | Lewis et al. | |
| 6,051,180 | A * | 4/2000 | Kwok | 264/555 |
| 6,074,597 | A | 6/2000 | Kwok et al. | |
| D429,263 | S | 8/2000 | Auber et al. | |
| 6,235,137 | B1 | 5/2001 | Van Eperen et al. | |
| 6,264,113 | B1 | 7/2001 | Dingler | |
| D456,427 | S | 4/2002 | Gressett, Jr. et al. | |
| 6,375,099 | B1 * | 4/2002 | McGuffey | 239/553.5 |
| D457,538 | S | 5/2002 | Gressett, Jr. et al. | |
| D460,092 | S | 7/2002 | Gressett, Jr. et al. | |
| D461,483 | S | 8/2002 | Gressett, Jr. et al. | |
| 6,540,152 | B2 | 4/2003 | Holm et al. | |
| 6,578,773 | B2 | 6/2003 | Holm et al. | |
| 6,676,038 | B2 | 1/2004 | Gressett, Jr. et al. | |
| 6,680,021 | B1 | 1/2004 | Kwok et al. | |
| 6,890,167 | B1 | 5/2005 | Kwok et al. | |
| 6,938,795 | B2 | 9/2005 | Barton, Jr. et al. | |
| D519,536 | S | 4/2006 | de Leeuw et al. | |
| D520,538 | S | 5/2006 | de Leeuw et al. | |
| D521,035 | S | 5/2006 | de Leeuw et al. | |
| D524,833 | S | 7/2006 | Folk et al. | |
| D529,321 | S | 10/2006 | Gould et al. | |
| D536,354 | S | 2/2007 | Kufner et al. | |
| D550,261 | S | 9/2007 | Bondeson et al. | |
| 2005/0205689 | A1 | 9/2005 | Crane et al. | |
| 2009/0258138 | A1 | 10/2009 | Burmester et al. | |

FOREIGN PATENT DOCUMENTS

| | | | |
|---|---|---|---|
| DE | 19715740 | A1 | 4/1997 |
| EP | 0893517 | A2 | 1/1999 |
| EP | 0979885 | A2 | 2/2000 |
| EP | 1155745 | A2 | 11/2001 |
| EP | 0835952 | B1 | 2/2003 |
| EP | 0872580 | B1 | 6/2005 |
| GB | 756907 | | 9/1956 |
| GB | 1392667 | | 4/1975 |
| WO | 9207122 | A1 | 4/1992 |
| WO | 9315895 | A1 | 8/1993 |
| WO | 9904950 | A1 | 2/1999 |

OTHER PUBLICATIONS

Gregory F. Ward, Micro-Denier Nonwoven Process and Fabrics, on or about Oct. 17, 1997, pp. 1-9.

Scott R. Miller, Beyond Meltblowing: Process Refinement in Microfibre Hot Melt Adhesive Technology, Edana 1998 International Nonwovens Symposium, 11 pgs.

European Patent Office, European Search Report in EP Application No. 07122920, Aug. 27, 2008.

Today's Idea, Nordson Unveils Diaper Elastic System, Oct. 1988, 1 pg.

Nordson Corporation, Adhesive and Powder Application Systems for the Nonwoven Industry, 1992, 7 pgs.

Edward K. McNalley et al., J&M Laboratories, Durafiber/Durastitch Adhesives Applications Methods Featuring Solid State Application Technology disclosed Sep. 8, 1997 at Inda-Tec 97 Meeting, Cambridge MA, pp. 26.1-26-8.

* cited by examiner

MULTI-PLATE NOZZLE AND METHOD FOR DISPENSING RANDOM PATTERN OF ADHESIVE FILAMENTS

TECHNICAL FIELD

The present invention relates generally to air-assisted nozzles and systems for extruding and moving filaments of viscous liquid in desired patterns and, more particularly, air-assisted dispensing of hot melt adhesive filaments.

BACKGROUND

Various dispensing systems have been used in the past for applying patterns of viscous liquid material, such as hot melt adhesives, onto a moving substrate. In the production of disposable diapers, incontinence pads and similar articles, for example, hot melt adhesive dispensing systems have been developed for applying a laminating or bonding layer of hot melt thermoplastic adhesive between a nonwoven fibrous layer and a thin polyethylene backsheet. Typically, the hot melt adhesive dispensing system is mounted above a moving polyethylene backsheet layer and applies a uniform pattern of hot melt adhesive material across the upper surface width of the backsheet substrate. Downstream of the dispensing system, a nonwoven layer is laminated to the polyethylene layer through a pressure nip and then further processed into a final usable product.

In various known hot melt adhesive dispensing systems, continuous filaments of adhesive are emitted from a multiple adhesive outlet die with multiple process air jets oriented in various configurations adjacent the circumference of each adhesive outlet. The multiple air jets discharge air generally tangentially relative to the orientation of the discharged adhesive filament or fiber as the filament emerges from the die orifice. This process air can generally attenuate each adhesive filament and cause the filaments to move back and forth in overlapping or non-overlapping patterns before being deposited on the upper surface of the moving substrate.

Manufacturers of diaper products and others remain interested in small fiber technology for the bonding layer of hot melt adhesive in nonwoven and polyethylene sheet laminates. To this end, hot melt adhesive dispensing systems have incorporated slot nozzle dies with a pair of angled air channels formed on either side of the elongated extrusion slot of the die. As the hot melt adhesive emits from the extrusion slot as a continuous sheet or curtain, pressurized process air is emitted as a pair of curtains from the air channels to impinge upon, attenuate and fiberize the adhesive curtain to form a uniform fibrous web of adhesive on the substrate. Fibrous web adhesive dispensers have incorporated intermittent control of adhesive and air flows to form discrete patterns of fibrous adhesive layers with well defined cut-on and cut-off edges and well defined side edges.

Meltblown technology has also been adapted for use in this area to produce a hot melt adhesive bonding layer having fibers of relatively small diameter. Meltblown dies typically include a series of closely spaced adhesive nozzles or orifices that are aligned on a common axis across the die head. A pair of angled air channels or individual air passages and orifices are positioned on both sides of the adhesive nozzles or orifices and align parallel to the common nozzle axis. As hot melt adhesive discharges from the series of aligned nozzles or orifices, pressurized process air is discharged from the air channels or orifices and attenuates the adhesive fibers or filaments before they are applied to the moving substrate.

While meltblown technology has been used to produce fibrous adhesive layers on moving substrates, it has various areas in need of improvement. As those skilled in the art will appreciate, meltblown technology typically uses a high volume of high velocity air to draw down and attenuate the emitted adhesive filaments. The high velocity air causes the fibers to oscillate in a plane that is generally aligned with the movement of the substrate, i.e., in the machine direction. To adequately blend adjacent patterns of adhesive to form a uniform layer on the substrate, meltblown dispensers require the nozzles to be closely spaced. Moreover, the volume and velocity of the air must be high enough to sufficiently agitate and blend adjacent fibers.

However, the high volume of air used in conventional meltblown dispensers adds to the overall operational cost as well as reduces the ability to control the pattern of emitted fibers. One byproduct of the high velocity air is "fly" in which the fibers get blown away from the desired deposition pattern. The "fly" can be deposited either outside the desired edges of the pattern, or even build up on the dispensing equipment which can cause operational problems that require significant maintenance. Another byproduct of the high velocity air and closely spaced nozzles is "shot" in which adjacent adhesive fibers become entangled and form globules of adhesive on the backsheet substrate. "Shot" is undesirable as it can cause heat distortion of the delicate polyethylene backsheet.

It will be further appreciated by those skilled in the art that when typical meltblown dies are placed in side-by-side fashion across the width of a moving substrate a less consistent fiber pattern on the substrate results. This occurs since each meltblown die has continuous sheets of air formed on either side and these sheets of air are interrupted between adjacent meltblown dies.

Other air-assisted nozzles or dies use capillary style tubes mounted in a nozzle or die body for extruding filaments of thermoplastic material. Air passages are provided adjacent to the tubes, and the ends of the tubes project outwardly relative to the outlets of the air passages.

Various forms of laminated plate technology are known for extruding rows of adhesive filaments in an air assisted manner. These include dispensing nozzles or dies constructed with slotted plates for discharging filaments of liquid and process or pattern air for attenuating and moving the discharged filaments in a desired pattern. These nozzles or dies present various issues relating to their performance, design complexity and large numbers of plates needed to complete the assembly. Therefore, improvements remain needed in this area of technology.

SUMMARY

The present invention, in an illustrative embodiment, provides a nozzle for dispensing a random pattern of liquid adhesive filaments. The nozzle includes first and second air shim plates, an adhesive shim plate and first and second separating shim plates. The first and second air shim plates each have respective pairs of air slots. Each air slot has a process air inlet and a process air outlet and the air slots of each pair converge toward one another such that the process air inlets are farther apart than the process air outlets in each pair. The adhesive shim plate includes a plurality of liquid slots each with a liquid inlet and a liquid outlet. The adhesive shim plate is positioned between and lies parallel to the first and second process air shim plates such that one of the liquid slots extends generally centrally between a pair of the air slots in the first process air shim plate and a pair of the air slots in the second process air shim plate. In this manner, four process air outlets are associated with each of the liquid outlets. The process air slots are adapted to receive pressurized process air and the liquid slots are adapted to receive pressurized liquid adhesive. The pressurized process air discharges from each group of the four process air outlets and forms a zone of turbulence for moving the filament of liquid adhesive discharging from the associated liquid outlet in a random pattern. The nozzle further includes first and second end plates securing together and sandwiching the first and second process air shim plates, the adhesive shim plate and the first and second separating shim plates. The first end plate includes a process air inlet communicating with the pairs of air slots in the first and second process air shim plates and a liquid adhesive inlet communicating with the liquid slots in the adhesive shim plate.

Various additional features are incorporated into the illustrative embodiment of the nozzle. For example, the first and second process air shim plates have first and second opposite ends and the pairs of process air slots respectively angle in a progressive manner outwardly from a central portion of each process air shim plate toward the opposite ends of the process air shim plates. This assists with spreading the pattern of adhesive filaments outwardly in opposite directions along the width of the nozzle. The adhesive shim plate also includes opposite ends and at least the liquid slots closest to the opposite ends of the adhesive shim plate respectively angle outwardly toward the opposite ends. This may assist with spreading the adhesive filament pattern in opposite directions.

In the illustrative embodiment, the first and second end plates further comprise respective process air passages for directing pressurized process air between the first and second end plates. The first end plate is generally L-shaped and includes a top surface generally orthogonal to planes containing the first and second process air shim plates, the adhesive shim plate and the first and second separating shim plates, and a side surface generally parallel to the planes containing the first and second process air shim plates, the adhesive shim plate and the first and second separating shim plates. The liquid adhesive inlet and the process air inlet are formed in the top surface.

The invention further contemplates methods directed generally to the manner in which liquid filaments and process air are discharged to form a random pattern of filaments on a substrate.

Various additional features and advantages of the invention will become more readily apparent to those of ordinary skill in the art upon review of the following detailed description of the illustrative embodiment taken in conjunction with the accompanying drawings.

DETAILED DESCRIPTION OF THE ILLUSTRATIVE EMBODIMENTS

Figure 1:
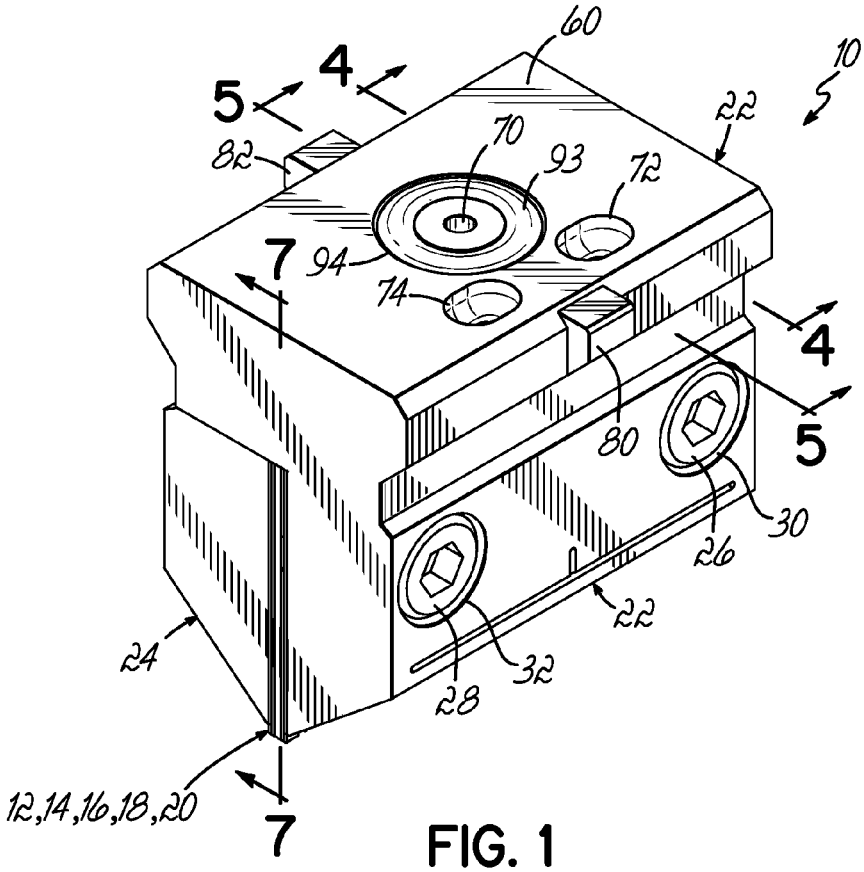
FIG. 1 is an assembled perspective view of a nozzle constructed in accordance with an illustrative embodiment of the invention.
Figure 2:
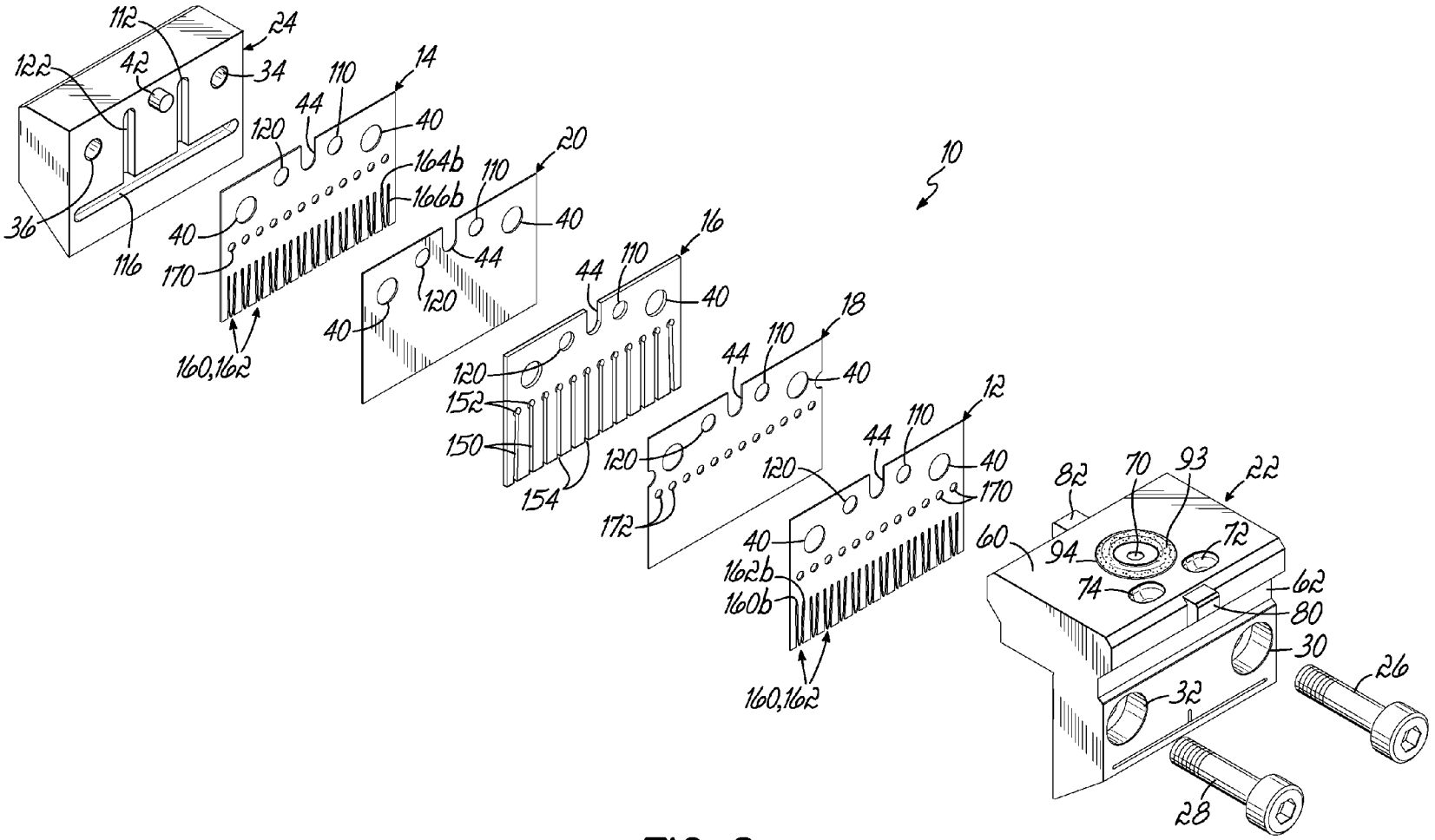
FIG. 2 is a disassembled perspective view of the nozzle shown in FIG. 1.

Referring first to FIGS. 1 and 2, a nozzle 10 in accordance with one illustrative embodiment is shown and generally includes first and second process air shim plates 12, 14, an adhesive shim plate 16, first and second separating shim plates 18, 20, and first and second end plates 22, 24. The entire assembly is held together as shown in FIG. 1 by, for example, a pair of threaded fasteners 26, 28 that extend through holes 30, 32 in the first end plate 22 and into threaded holes 34, 36 in the second end plate 24. As further shown in FIG. 2, respective holes 40 in the air shim plates 12, 14, separating shim plates 18, 20 and adhesive shim plate 16 allow passage of the threaded fasteners 26, 28 as well. The second end plate 24 includes a projection 42 serving as a locating member that extends through respective upper slots 44 in the air shim plates 12, 14, separating shim plates 18, 20, and adhesive shim plate 16. The projection or locating member 42 is then received in a blind bore 50 (FIG. 3) in the first end plate 22.

The first end plate 22 is a generally L-shaped member and includes a top surface 60 generally orthogonal to planes that contain the first and second process air shim plates 12, 14, the adhesive shim plate 16 and the first and second separating shim plates 18, 20. A side surface 62 generally parallel to the planes containing these same shim plates receives the threaded fasteners 26, 28. The top surface 60 includes an adhesive inlet 70 and a pair of process air inlets 72, 74. The first end plate 22 also includes oppositely extending projections 80, 82 that may be used for securing the nozzle 10 to a dispensing valve or module (not shown) as further shown and described in U.S. Pat. No. 6,676,038, the disclosure of which is hereby incorporated by reference herein.

Figure 3:
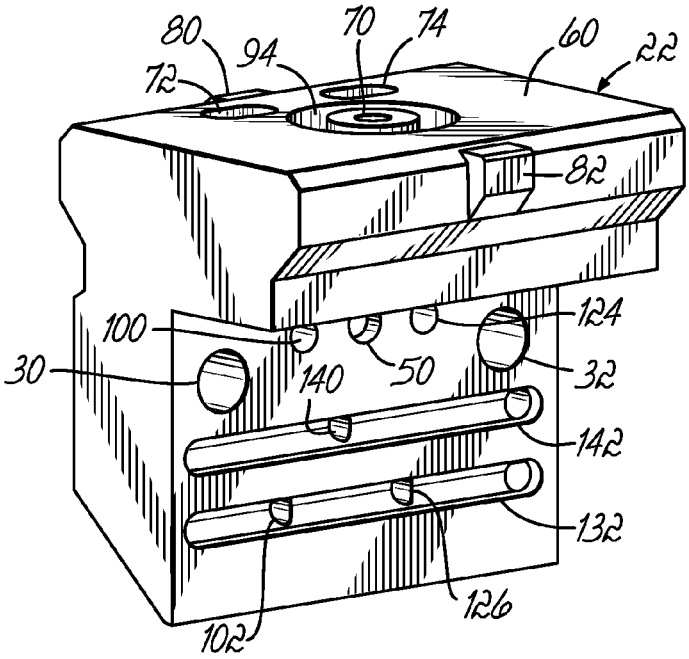
FIG. 3 is a perspective view the inside of an end plate of the nozzle shown in FIG. 1.
Figure 4:
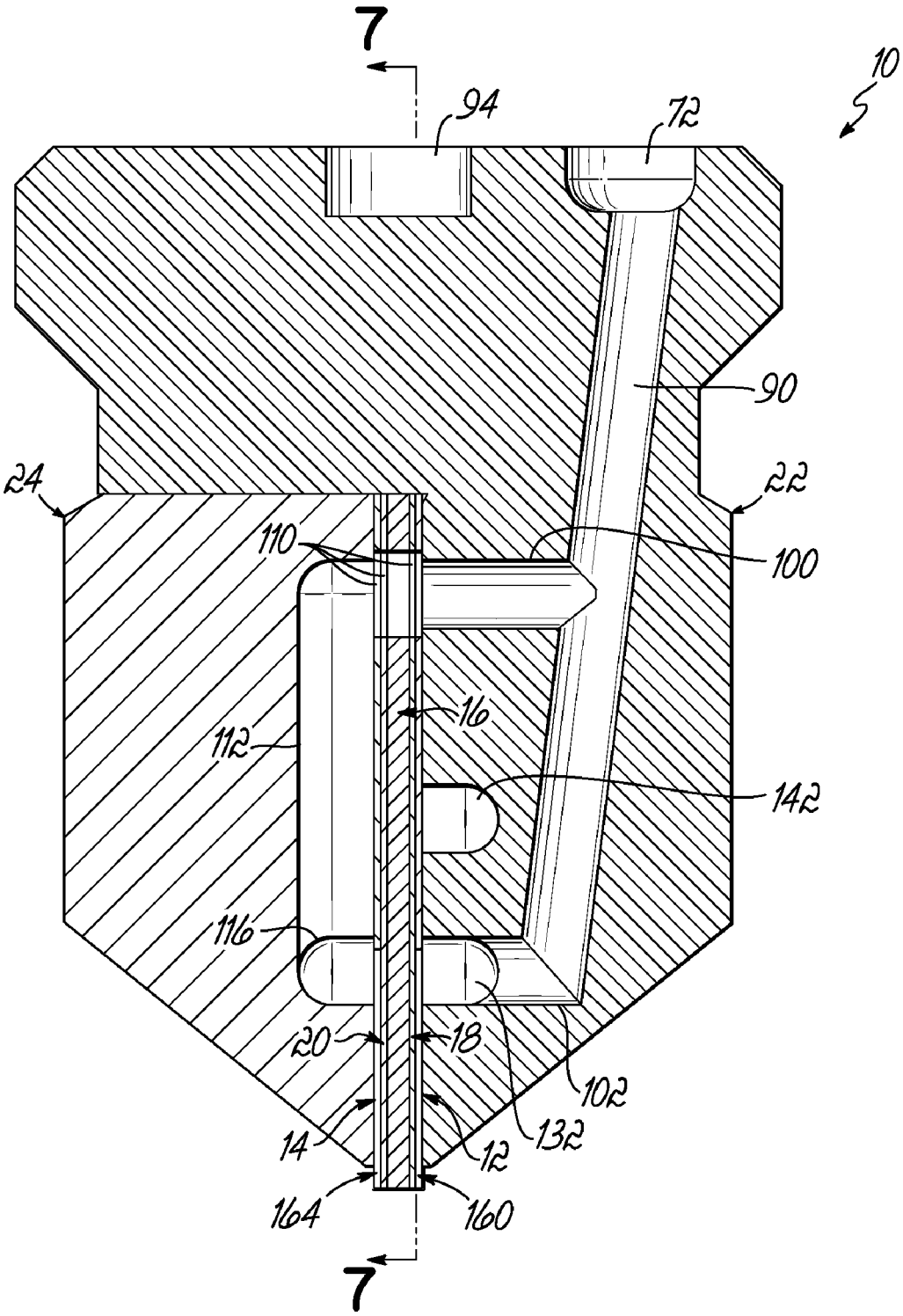
FIG. 4 is a cross sectional view taken along line 4-4 of FIG. 1.
Figure 5:
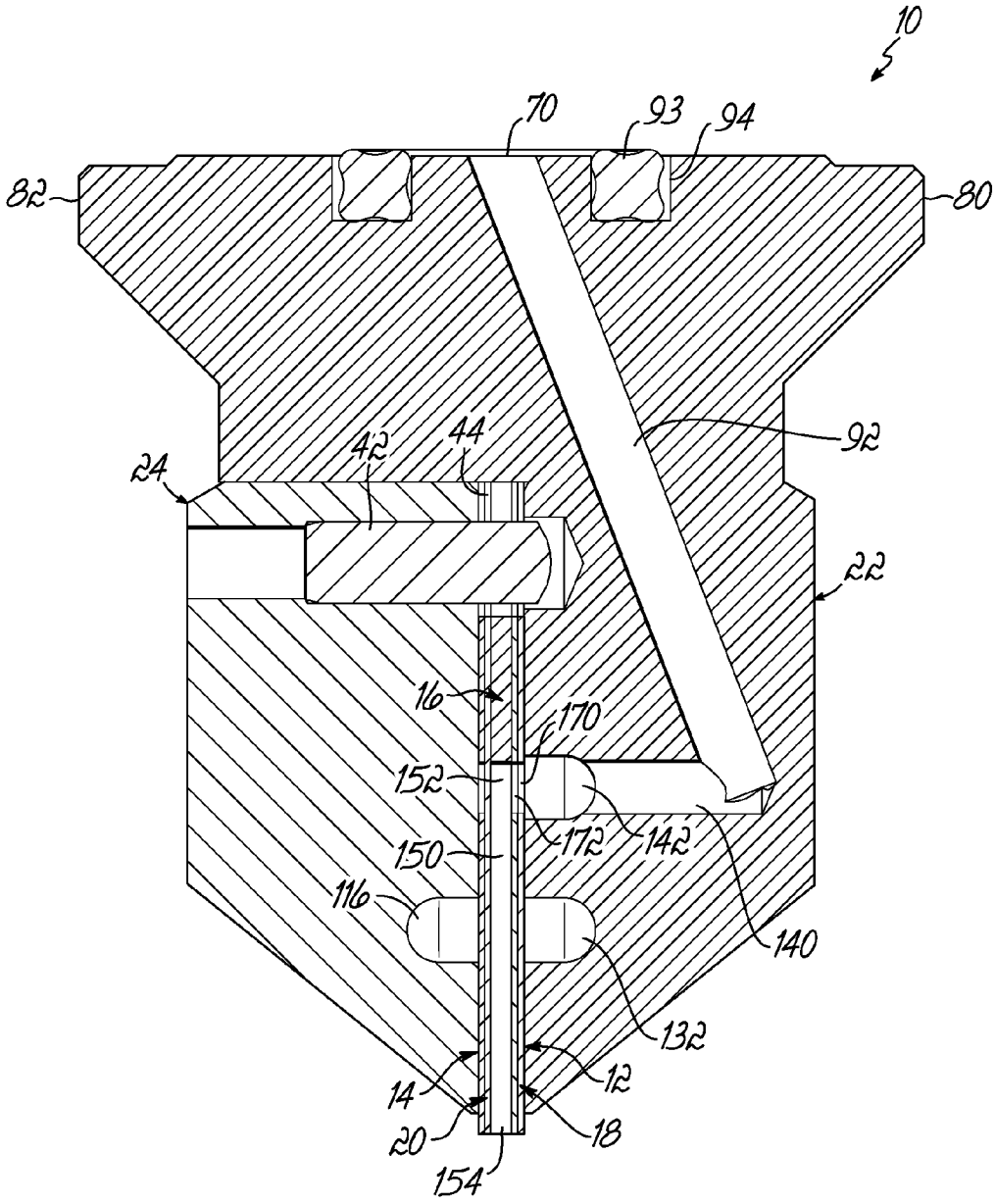
FIG. 5 is a cross sectional view taken along line 5-5 of FIG. 1.

Referring to FIGS. 2-5, the first end plate 22 includes a process air inlet passage 90 (FIG. 4) communicating with the inlet 72 and a liquid adhesive inlet passage 92 (FIG. 5) communicating with the liquid inlet 70. A seal member 93 located in a groove 94 may be used to seal liquid inlet 70. As also shown in FIG. 4, the process air inlet passage 90 communicates with first and second air distribution passages 100, 102 that respectively communicate with opposite sides of the shim plate assembly 12, 14, 16, 18, 20. It will be appreciated that a second identical distribution passage system (not shown) in the first end plate 22 communicates with the second air inlet 74 (FIG. 2) to provide additional pressurized air to opposite sides of shim plate assembly 12, 14, 16, 18, 20. The upper distribution passage 100 passes through the shim plate assembly 12, 14, 16, 18, 20 through aligned holes 110 and through a vertical recess 112 (FIGS. 2 and 4) and, finally, into a horizontally extending slot 116 in the second end plate 24. Another series of aligned holes 120 and another vertical recess 122 are provided to receive process air from the other air inlet 74 through the previously mentioned identical distribution passage system. In this regard, distribution passages 124, 126 shown in FIG. 3 communicate with air inlet 74. Passage 124 aligns with holes 120 and slot 122 shown in FIG. 2, while passage 126 communicates with recess 132 as shown in FIG. 3. The horizontally extending slot 116 communicates with one side of the shim plate assembly, as discussed further below. The other distribution passage 102 communicates with a lower horizontal recess 132 contained in the first end plate (FIGS. 3 and 4). This horizontal recess 132 communicates with the right side of the shim plate assembly (as viewed in FIG. 4) for supplying process air to the first process air shim plate 12. As shown in FIG. 5, the liquid inlet passage 92 communicates with a liquid distribution passage 140 and an upper horizontal slot 142 (FIG. 3) in the first end plate 22. This upper horizontal slot 142 communicates with the adhesive shim plate 16 as further described below.

Figure 6:
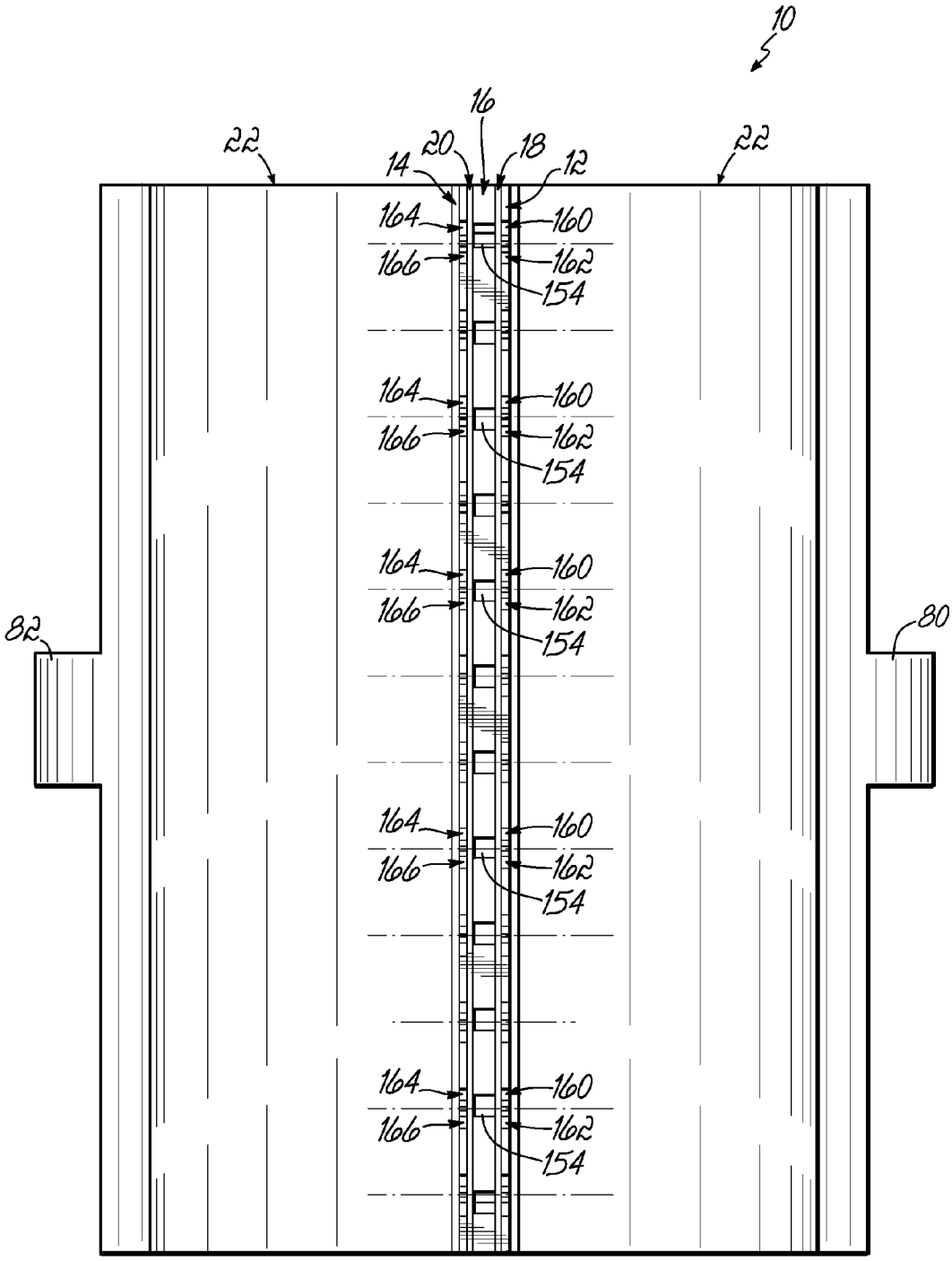
FIG. 6 is a bottom view of the nozzle shown in FIG. 1.

Again referring to FIG. 2, the adhesive shim plate 16 includes a plurality of liquid slots 150 each with a liquid inlet 152 and a liquid outlet 154. The adhesive shim plate 16 is positioned between and lies parallel to the first and second process air shim plates 12, 14 such that one of the liquid slots 150 extends generally centrally between a first pair of air slots 160, 162 in the first process air shim plate 12 and also generally centrally between a second pair of the air slots 164, 166 in the second process air shim plate 14. As best viewed in FIG. 7, each first pair of air slots 160, 162 is directly aligned with a corresponding second pair of air slots 164, 166 (not shown in FIG. 7), although the pairs of air slots 160, 162 and 164, 166 are separated by adhesive shim plate 16 and separating shim plates 18, 20. Thus, as shown in FIG. 6, four process air outlets 160*a*, 162*a*, 164*a*, 166*a* are associated with each of the liquid outlets 154. As further shown in FIGS. 2 and 7, air slots 160, 162 converge toward each other and air slots 164, 166 converge toward each other such that the process air inlets 160*b*, 162*b* and 164*b*, 166*b* are farther apart than the corresponding process air outlets 160*a*, 162*a* and 164*a*, 166*a* in each pair. However, none of the air slots 160, 162, 164, 166 converge toward their associated liquid slot 150 since the respective pairs of slots 160, 162 and 164, 166 are each contained in parallel planes different from the plane containing he liquid slots 150. From a review of FIG. 7, it will be appreciated that for each of the liquid slots 150, one pair of converging process air slots 160, 162 is shown and another pair is hidden behind the first pair but is directly aligned therewith in the second process air shim plate 14.

In the manner previously described, pressurized process air is directed downwardly through the respective pairs of slots 160, 162 and 164, 166 in both process air shim plates 12, 14. In this regard, the horizontal slot 132 communicates pressurized air to the inlets 160*b*, 162*b* of slots 160, 162 in the first process air shim plate 12. The horizontal slot 116 communicates pressurized air to the inlets 164*b*, 166*b* of the slots 164, 166 in the second process air shim plate 14. Liquid hot melt adhesive is directed into the liquid inlet passage 70 to the distribution passage 140 and the upper horizontal slot 142 in the first end plate 22. The upper horizontal slot 142 in the first end plate 22 communicates with respective aligned holes 170, 172 in the first process air shim plate 12 and the first separating shim plate 18 and, finally, into the upper inlets 152 of the liquid slots 150. The second process air shim plate 14 also includes such holes 170 to allow full interchangeability between the first and second process air shim plates 12, 14. In the construction shown in FIG. 2, the holes 170 in the second process air shim plate 14 remain unused. The separating shim plates 18, 20 are utilized to seal off the respective air slots 160, 162 and 164, 166 from the liquid slots 150.

Nozzle 10 has a design such that it may be flipped or rotated 180° from left to right when mounting to a valve module (not shown). Furthermore, the respective liquid slots 150 and air slots 160, 162, 164, 166 may be formed along any desired width or width portion(s) of the respective air shim plates 12, 14 and adhesive shim plate 16 depending on the needs of the application. The air shim plates may always have the full distribution of air slots 160, 162, 164, 166 as shown for nozzle 10 since providing additional air streams typically will not adversely affect the discharged filaments.

Figure 7:
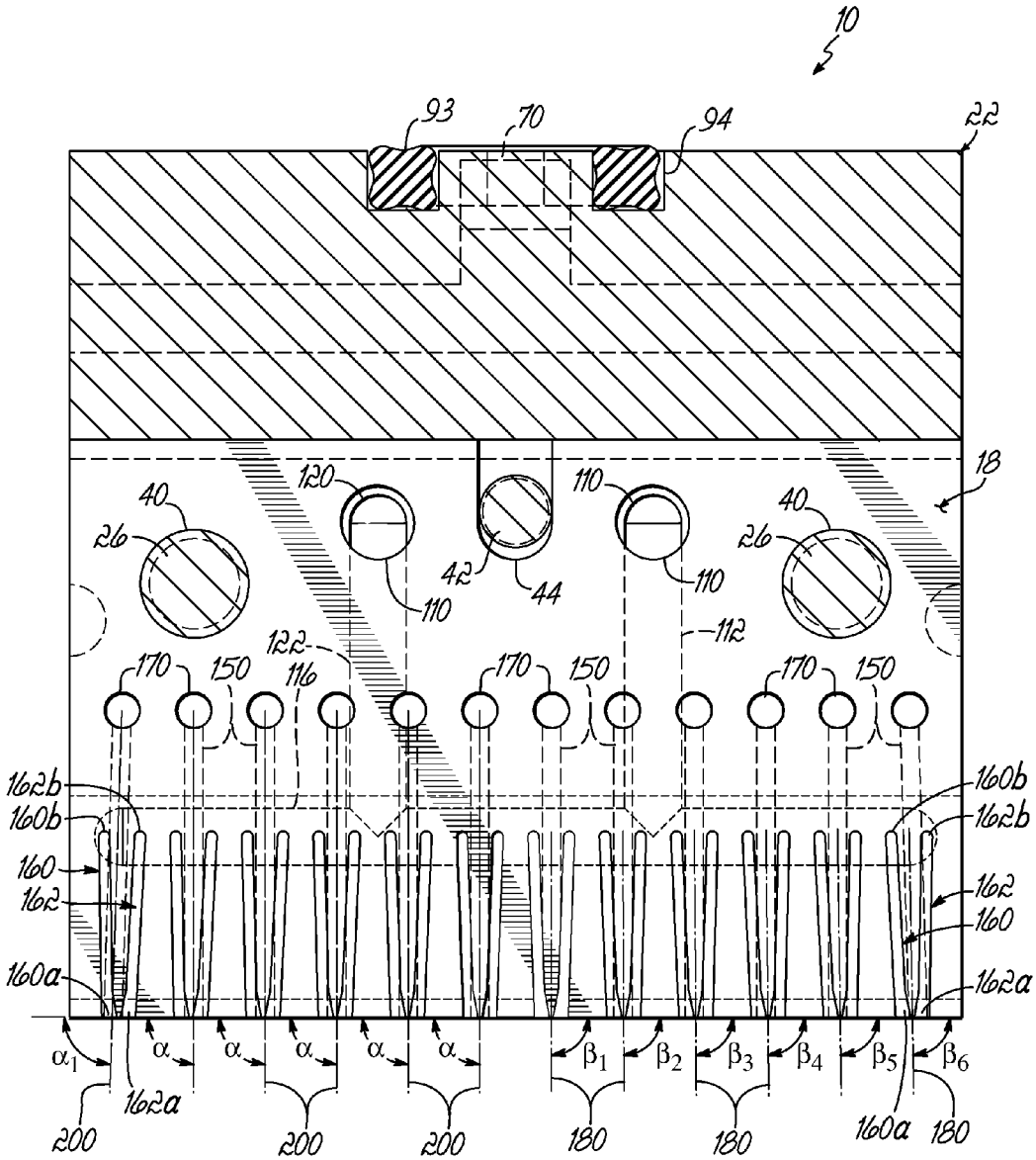
FIG. 7 is a cross sectional view generally taken along lines 7-7 of FIGS. 1 and 4.

As further shown in FIG. 7, twelve respective groupings of 1) pairs of air slots 160, 162, 2) pairs of air slots 164, 166 (FIG. 2) and 3) individual liquid slots 150 are shown in the illustrative embodiment. The right hand side of FIG. 7 illustrates respective centerlines 180 centered between the respective pairs of converging air slots 160, 162. These air slot centerlines and, therefore, the respective pairs of air slots 160, 162 gradually angle toward an outer end of the process air shim plate 12. Thus, for example, the angles of the respective centerlines 180 may gradually become smaller relative to horizontal with $\beta_1$ being the largest angle at 90° and $\beta_6$ being the smallest angle at 87.5°. In this illustrative embodiment, the angles may, for example, be as follows:

$\beta_1$=90°
$\beta_2$=89.5°
$\beta_3$=89°
$\beta_4$=88.5°
$\beta_5$=88°
$\beta_6$=87.5°

Of course, other angles may be chosen instead, depending on application needs. The second process air shim plate 14 may be configured in an identical manner.

On the left hand side of FIG. 7, additional centerlines 200 are shown through the respective centers of the liquid slots 150. In this embodiment, angle $\alpha$ may be 90°, while angle $\alpha_1$ may be less than 90°, such as 88.3°. In this manner, the outermost or endmost liquid slot 150 is angled outwardly toward the outer edge of the shim plate 16. The outermost liquid slot 150 on the opposite edge of the assembly may also include this feature. Likewise, the respective six pairs of process air slots 160, 162 on the left hand side of FIG. 7 may also be gradually fanned (as pairs) outward or to the left just as the six pairs on the right hand side of FIG. 7 are "fanned" or angled to the right. It will be understood that any "fanning" or angling of air or liquid slots on the left side of the nozzle 10 will be to the left while any "fanning" or angling of air or liquid slots on the right side of the nozzle 10 will be to the right. Adhesive filaments discharging from the liquid slots 150 will fan outwardly generally from the center point of the nozzle 10, i.e., to the left and to the right as viewed in FIG. 7, such that the overall pattern width of randomized adhesive filaments will be greater than the width between the two outermost or endmost liquid slot outlets 152 and, desirably, may have a width at least as great as the width of the nozzle 10 itself. It will further be appreciated that any number of the liquid slots 150 may each be gradually fanned or angled outwardly relative to a center point of the nozzle, as shown in FIG. 7, rather than only the outermost liquid slots 150 having this configuration.

As one additional modification, more than one adhesive shim plate 16 may be used in adjacent, side-by-side stacked format. In this format, adhesive slots in one adhesive shim plate would communicate, respectively, with adhesive slots in an adjacent adhesive shim plate. This would allow, for example, the adhesive slots in each adhesive shim plate to form only a portion of the overall adhesive outlet. If, for example, one or more of the adhesive slots of each adhesive shim plate that communicate with each other is formed with a different shape, a desired overall cross sectional shape for the resulting adhesive filament may be obtained. In this manner, a variety of different adhesive filament shapes may be obtained in different nozzles or along the width of the same nozzle. Cross sectional shapes of the adhesive filaments may, for example, take the form of "plus" signs or "C"-shapes or other geometric configurations.

Figure 8:
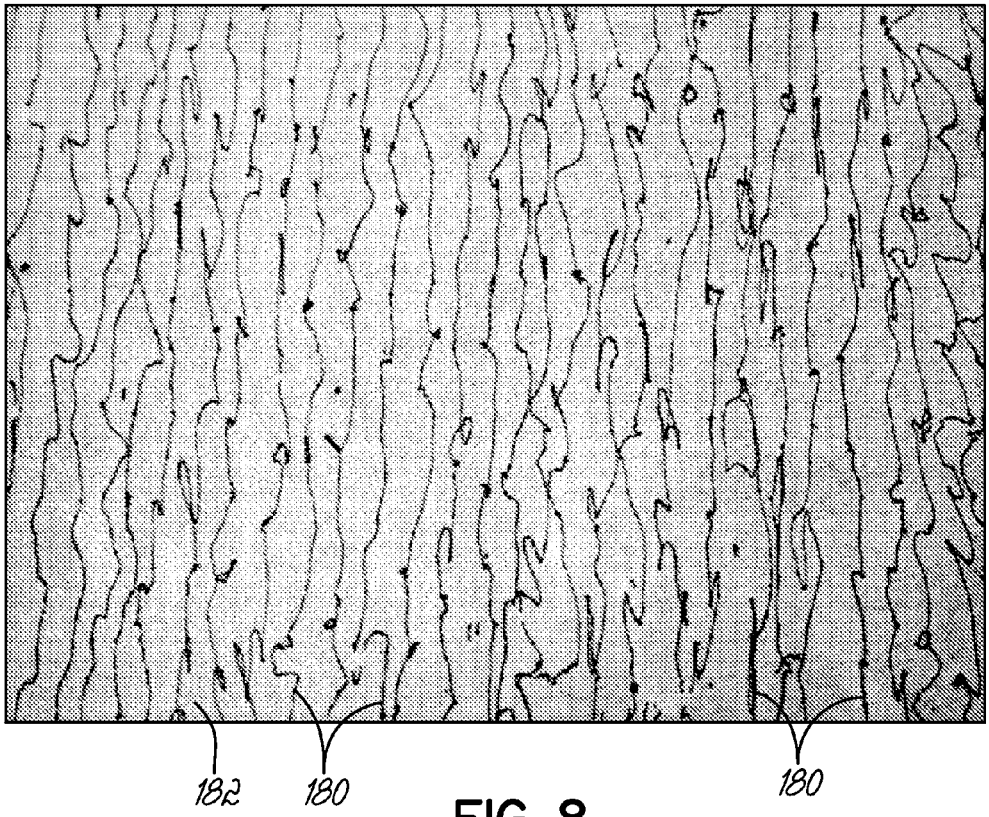
FIG. 8 is an elevational view of a random filament pattern produced with a nozzle constructed in accordance with the principles discussed herein.

The discharged stream of pressurized air exiting from each process air outlet 160*a*converges and impacts against a process air stream exiting from each associated outlet 162*a* of the pair 160*a*, 162*a*. In a similar manner, respective process air streams exiting outlets 164*a* impact against the streams exiting from process air outlets 166*a*. This forms a zone of air turbulence directly below each liquid outlet 154 of the nozzle and causes the continuous adhesive filaments 180 exiting the associated liquid outlets 154 to move side-to-side or back and forth in random directions forming an erratic, non-uniform or random pattern as, for example, shown in FIG. 8. In this regard, FIG. 8 illustrates a substrate 182 onto which the random pattern of multiple, continuous filaments 180 has been deposited after discharge from one or more nozzles constructed in accordance with nozzle 10 as generally described herein.

While the present invention has been illustrated by a description of various illustrative embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims, wherein what is claimed is:

The invention claimed is:

1. A nozzle for dispensing a random pattern of liquid adhesive filaments, comprising:

first and second process air shim plates, said first and second process air shim plates each having respective pairs of air slots, each air slot having a process air inlet and a process air outlet and said air slots of each pair converging toward one another such that said process air inlets are farther apart than said process air outlets in each pair;

an adhesive shim plate having a plurality of liquid slots each with a liquid inlet and a liquid outlet, said adhesive shim plate positioned between and lying parallel to said first and second process air shim plates such that one of said liquid slots extends generally centrally between a pair of said air slots in said first process air shim plate and a pair of said air slots in said second process air shim plate thereby associating four process air outlets with each of said liquid outlets, said process air slots adapted to receive pressurized process air and said liquid slots adapted to receive pressurized liquid adhesive, each group of said four process air outlets capable of discharging the pressurized process air for moving the filament of liquid adhesive discharging from the associated liquid outlet in a random pattern;

a first separating shim plate positioned between said first process air shim plate and said adhesive shim plate;

a second separating shim plate positioned between said second process air shim plate and said adhesive shim plate; and first and second end plates secured together and sandwiching said first and second process air shim plates, said adhesive shim plate and said first and second separating shim plates together, said first end plate including a process air inlet communicating with said pairs of air slots in said first and second process air shim plates and a liquid adhesive inlet communicating with said liquid slots in said adhesive shim plate.

2. The nozzle of claim 1, wherein said first and second process air shim plates have first and second opposite ends, and said pairs of process air slots respectively angle outwardly in a progressive manner from a central portion of each process air shim plate toward said opposite ends of said process air shim plates to assist with spreading the pattern of adhesive filaments outwardly in opposite directions.

3. The nozzle of claim 2, wherein said adhesive shim plate includes opposite ends and at least said liquid slots closest to said opposite ends of said adhesive shim plate respectively angle outwardly toward said opposite ends.

4. The nozzle of claim 1, wherein said adhesive shim plate includes opposite ends and at least said liquid slots closest to said opposite ends of said adhesive shim plate respectively angle outwardly toward said opposite ends.

5. The nozzle of claim 1, wherein said first and second end plates further comprise respective process air passages for directing pressurized process air between said first and second end plates.

6. The nozzle of claim 1, wherein said first end plate is generally L-shaped and includes a top surface generally orthogonal to planes containing said first and second process air shim plates, said adhesive shim plate and said first and second separating shim plates, and a side surface generally parallel to the planes containing said first and second process air shim plates, said adhesive shim plate and said first and second separating shim plates, said liquid adhesive inlet and said process air inlet formed in said top surface.

* * * * *